US007225492B2

(12) United States Patent
Pratt

(10) Patent No.: US 7,225,492 B2
(45) Date of Patent: Jun. 5, 2007

(54) RAMP

(76) Inventor: Simon Pratt, 120 Pickford Lane, Bexleyheath, Kent DA7 4RS (GB)

( * ) Notice: Subject to any disclaimer, the term of this patent is extended or adjusted under 35 U.S.C. 154(b) by 0 days.

(21) Appl. No.: 10/564,676

(22) PCT Filed: Nov. 27, 2003

(86) PCT No.: PCT/GB03/05159

§ 371 (c)(1),
(2), (4) Date: Jan. 13, 2006

(87) PCT Pub. No.: WO2005/014129

PCT Pub. Date: Feb. 17, 2005

(65) Prior Publication Data

US 2006/0150347 A1 Jul. 13, 2006

(30) Foreign Application Priority Data

Jul. 22, 2003 (GB) ..... 3171493

(51) Int. Cl.
*E01D 1/00* (2006.01)

(52) U.S. Cl. ..... 14/69.5; 472/89

(58) Field of Classification Search ..... 14/69.5; 472/89; D21/817; D34/32; 119/847, 849
See application file for complete search history.

(56) References Cited

U.S. PATENT DOCUMENTS

| | | | | |
|---|---|---|---|---|
| 3,752,441 | A * | 8/1973 | Rogers | 254/88 |
| 4,129,916 | A | 12/1978 | Schlesinger et al. | |
| 4,421,210 | A * | 12/1983 | Sugino | 188/32 |
| 4,815,155 | A * | 3/1989 | Sommers | 5/659 |
| 5,749,615 | A * | 5/1998 | Itson | 296/26.03 |
| D412,224 | S * | 7/1999 | Adler | D30/119 |
| 6,463,613 | B1 * | 10/2002 | Thompson | 14/69.5 |
| 6,643,878 | B2 * | 11/2003 | Schmaltz et al. | 14/69.5 |
| 6,695,707 | B1 * | 2/2004 | Fernandez et al. | 472/89 |
| 6,782,577 | B2 * | 8/2004 | Rieber et al. | 14/71.1 |
| D495,770 | S * | 9/2004 | Hickey | D21/817 |
| 7,104,895 | B2 * | 9/2006 | Hickey | 472/89 |

FOREIGN PATENT DOCUMENTS

| | | |
|---|---|---|
| DE | 297 14 693 U1 | 12/1997 |
| FR | 2757075 | 6/1998 |

* cited by examiner

*Primary Examiner*—Gary S Hartmann
(74) *Attorney, Agent, or Firm*—Fay Sharpe LLP

(57) ABSTRACT

A collapsible ramp (100) comprising a collapsible deck (102) and a collapsible support structure (104). The deck (102) is composed of plural transverse panels (106, 110, 112, 114, 116) selectively joinable by tongue and groove connections (120, 122) and permanently interconnected by filament connecting means or hinges which allow the deck (102) to be rolled or folded. The support structure (104) includes foldable longitudinal members (126) which are interconnected by collapsible brace arms (142) and have foldable legs (148, 150) provided with feet (160) including screw threaded ground engaging members (168, 186). Protrusions (124) on the panels engage recesses (146) in the longitudinal members (126). The lowermost panel (106) includes a tapered distal edge (108) for facilitating ramp entry and the upper panel (116) has a rounded upper distal edge (118) for safety reasons. An upper surface (188) of the deck (102) substantially defines a transition curve making it particularly suitable for launching skaters and the like for airborne maneuvers.

20 Claims, 13 Drawing Sheets

FIG. 2
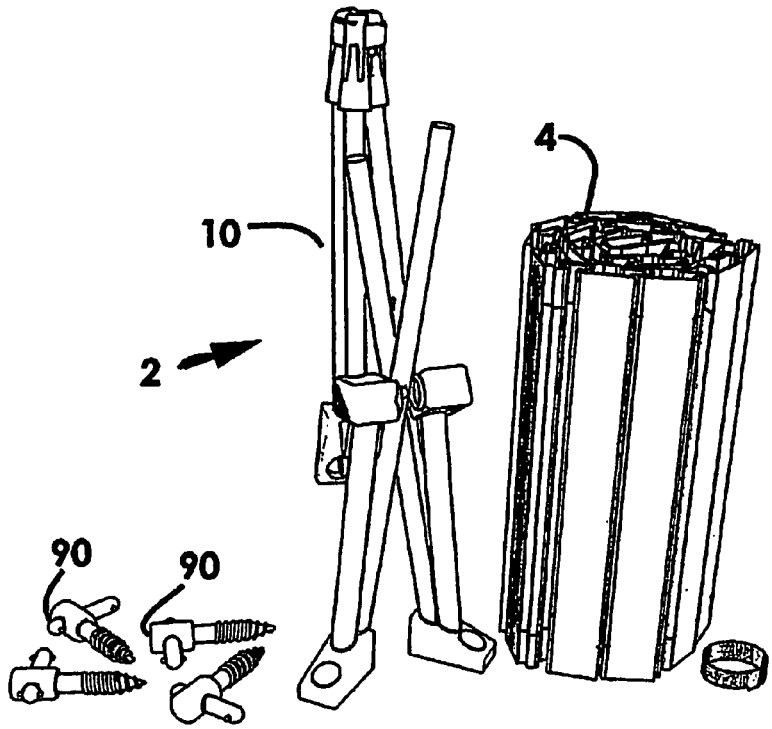
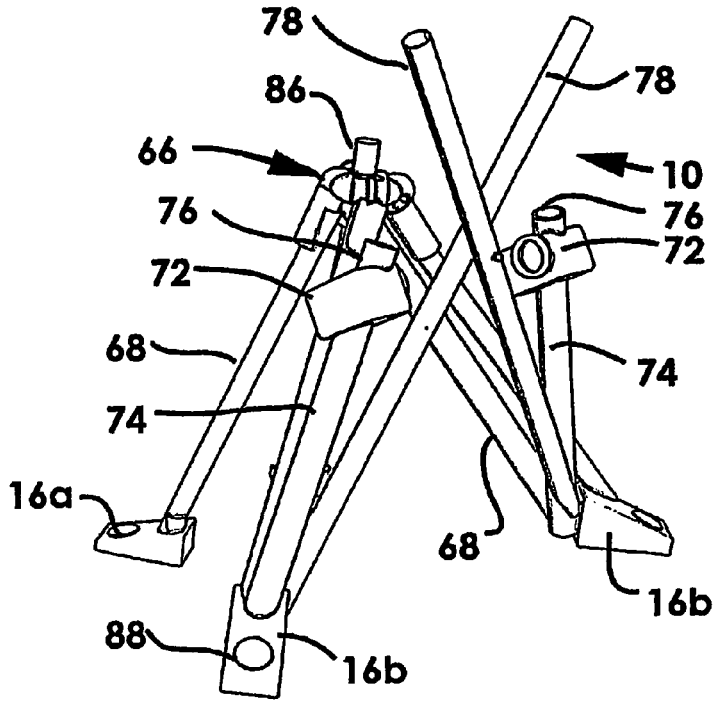
FIG. 3

FIG. 15
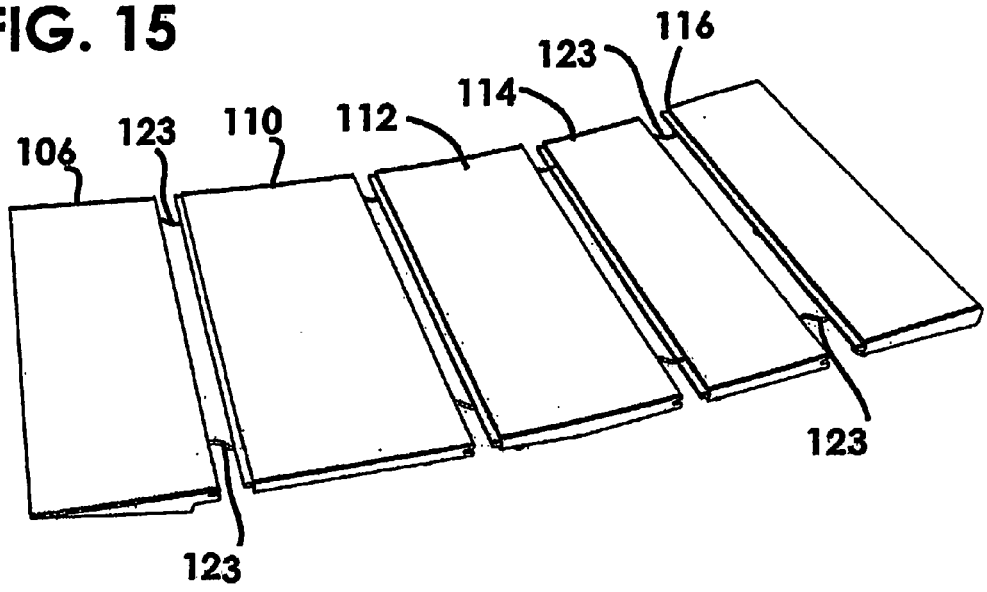
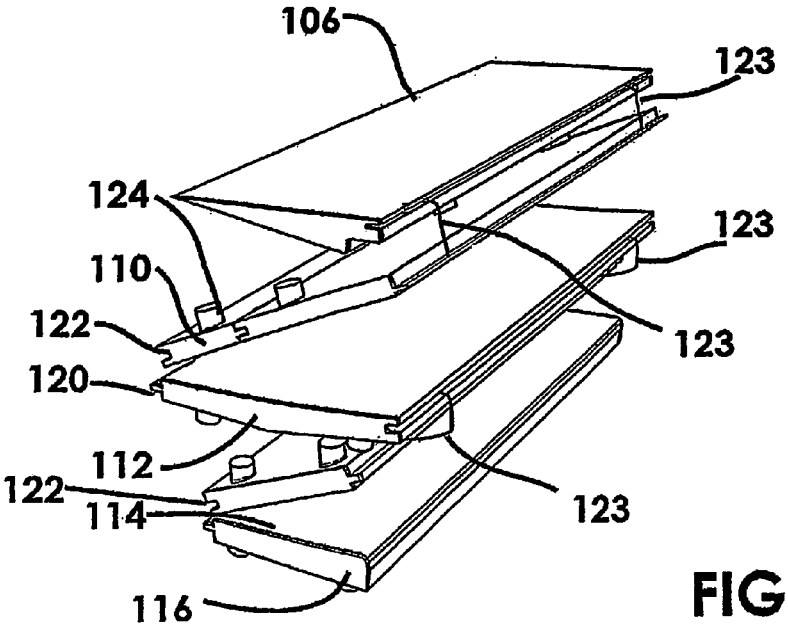
FIG. 16

FIG. 17
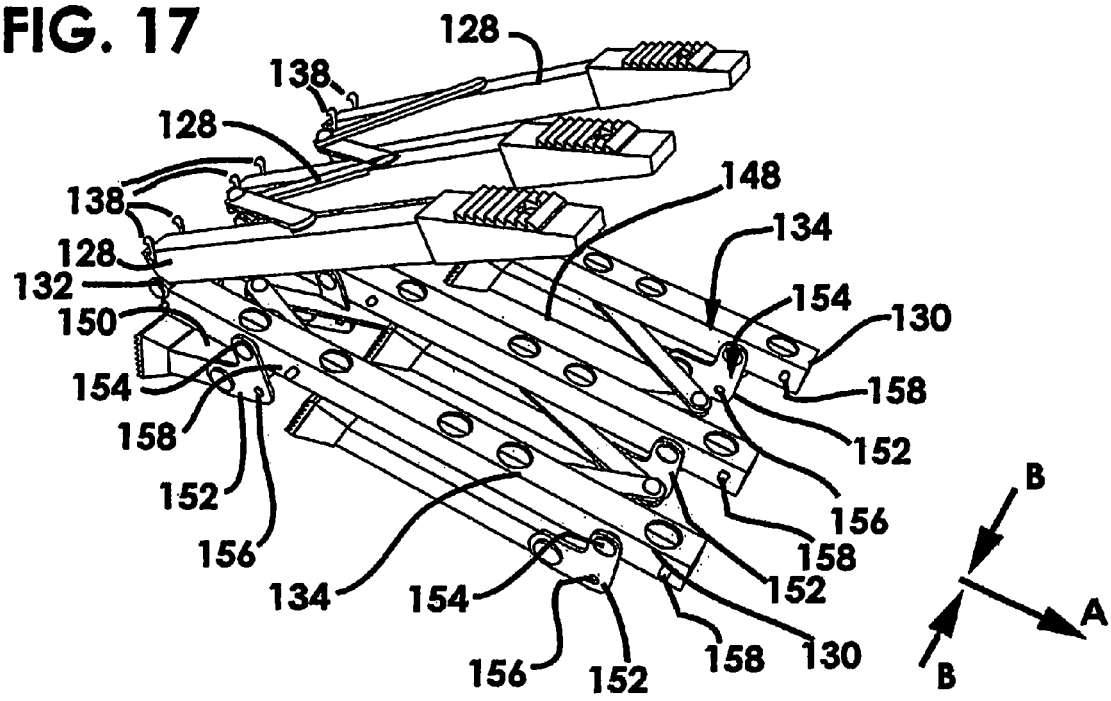
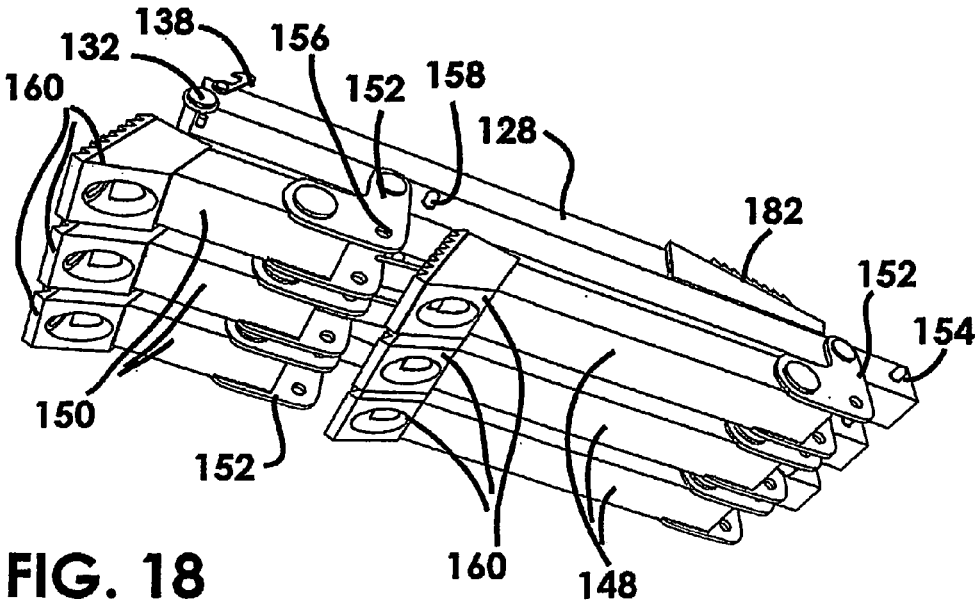
FIG. 18

RAMP

The present invention relates to a ramp suitable for use by rollerbladers, skateboarders, snowboarders, trick cyclists, mountain boarders and the like.

There are a growing number of parks being set up which provide facilities for skateboarders and the like (hereinafter merely referred to as skateboarders) in which ramps of various configurations are provided for assisting in the execution of jumps and tricks. The ramps are large fixed structures. When skateboarders are not at such parks the ability to perform such tricks is limited by suitable surfaces which can be found in the built environment. Such surfaces can be difficult to locate and are not always situated in convenient locations. It would accordingly be advantageous to provide a ramp which could easily be carried to set up at a convenient location. One attempt to provide such a ramp is described in U.S. Pat. No. 5,599,235. The ramp is constructed from three relatively large sections each of which would not be easy to transport and all three sections could certainly not be carried by a single person. Furthermore the ramp has an upper surface which defines abrupt changes of slope.

An object of the invention is to provide a ramp which is more convenient to transport and provides a better surface for launching a skateboarder from.

Thus according to the invention there is provided a collapsible ramp comprising a collapsible deck including a plurality of elongate or panel members and a collapsible support structure, the elongate members and support structure being configured such that when the deck is deployed on the support structure the deck has a generally concave upper surface and the ramp can be collapsed when not deployed.

Such a ramp can be designed to be packed into a relatively small volume and thereby more easily carried by a single person than the prior art ramps and the concave upper surface to the deck can be designed to provide a gentle transition curve which will accelerate the skateboarder upwards at a substantially uniform rate.

Preferably at least some and more preferably substantially all of the elongate members have a concave upper surface whereby, when the deck is deployed, its upper surface is substantially continuously curved. Such an arrangement is preferable to the elongate members each having a flat upper surface and the ramp curvature merely being provided by the juxtapositions of the elongate members relative to each other. The continuously curved upper surface will provide a near perfect surface for launching a skateboarder from.

More preferably the upper surface of the deployed deck substantially defines a transition curve.

So as to increase the rigidity of the ramp when deployed, adjacent elongate members preferably engage each other in a form locking manner when the deck is deployed.

Preferably the elongate members are interconnected whereby when the deck is separated from the support structure and in its collapsed state the elongate members remain connected to each other.

Conveniently, the elongate members are interconnected by at least one filament. Alternatively they may be interconnected by hinges with axes disposed parallel to longitudinal axes of the elongate members and configured to allow the deck to be rolled up when collapsed.

The elongate member, at an entry end of the deck, is preferably tapered in order that a smooth transition onto the ramp can be achieved.

The elongate member at an opposite or exit end of the deck preferably has a rounded upper distal edge to minimise the chance of an injury occurring if a skateboarder falls onto it.

The elongate members preferably comprise moulded plastics members since plastics materials can easily be moulded into any desired shape and will be durable. More preferably the elongate members are hollow open bottomed structures possibly of a tray like construction with a peripheral downwardly extending lip or wall. Such a construction provides a high strength to weight ratio and excellent rigidity.

Preferably the support structure comprises members which are hingeably interconnected in such a manner that they remain interconnected when the support structure is in a collapsed state. With such an arrangement, the time taken to deploy the support structure will be kept to a minimum.

Preferably the support structure includes longitudinal members each of which is foldable so as to reduce its length, thereby reducing the space taken up by the support structure when it is collapsed. For the same reason, the support structure preferably also includes longitudinal members laterally interconnected by collapsible bracing means, which bracing means are collapsible to permit adjacent longitudinal members to move towards each other.

To still further reduce the space taken up by the support structure when it is collapsed, preferably the support structure includes deck support members and legs which are hingeably interconnected to the deck support members.

The support structure may include prismatic, such as tubular, compression members which engage node or joint pieces.

To keep the weight of the support structure down it may also include tension members which hold other parts thereof in a deployed configuration.

In order to facilitate collapsing of the ramp, the deck is preferably located relative to the support structure by first engagement means on an underside of the deck which are selectively engageable with complementary second engagement means on the support structure.

To reduce ramp flexibility when the ramp is deployed the engagement means preferably acts to support the deck adjacent end regions thereof and at at least one intermediate region thereof.

The support structure preferably includes feet with through holes and fastening means adapted to pass through the holes for engagement with a support surface. With such an arrangement, the ramp can be securely anchored to surfaces such as soil and snow. The fastening means may be stakes or may be threaded so that they can be screwed into the support surface. Alternatively or preferably in addition the feet each include friction enhancing means on a lower surface thereof which may comprise texturing such as ribbing or projections or may comprise pads of material such as rubber.

The invention will now be described by way of example only with reference to the accompanying drawings in which:

FIG. 2 shows the ramp of FIG. 1 in a collapsed state;

FIG. 3 shows a support frame of the ramp in a partially deployed state;

FIG. 15 shows a perspective view of the deck of the ramp shown in FIG. 10 in a dismantled state;

FIG. 16 shows a perspective view of the deck shown in FIG. 15 in a partially folded state;

FIG. 17 shows a perspective view of the support structure of the ramp shown in FIG. 10 in a partially collapsed state;

FIG. 18 shows a perspective view of the support structure shown in FIG. 17 in a fully collapsed state.

Figure 1:
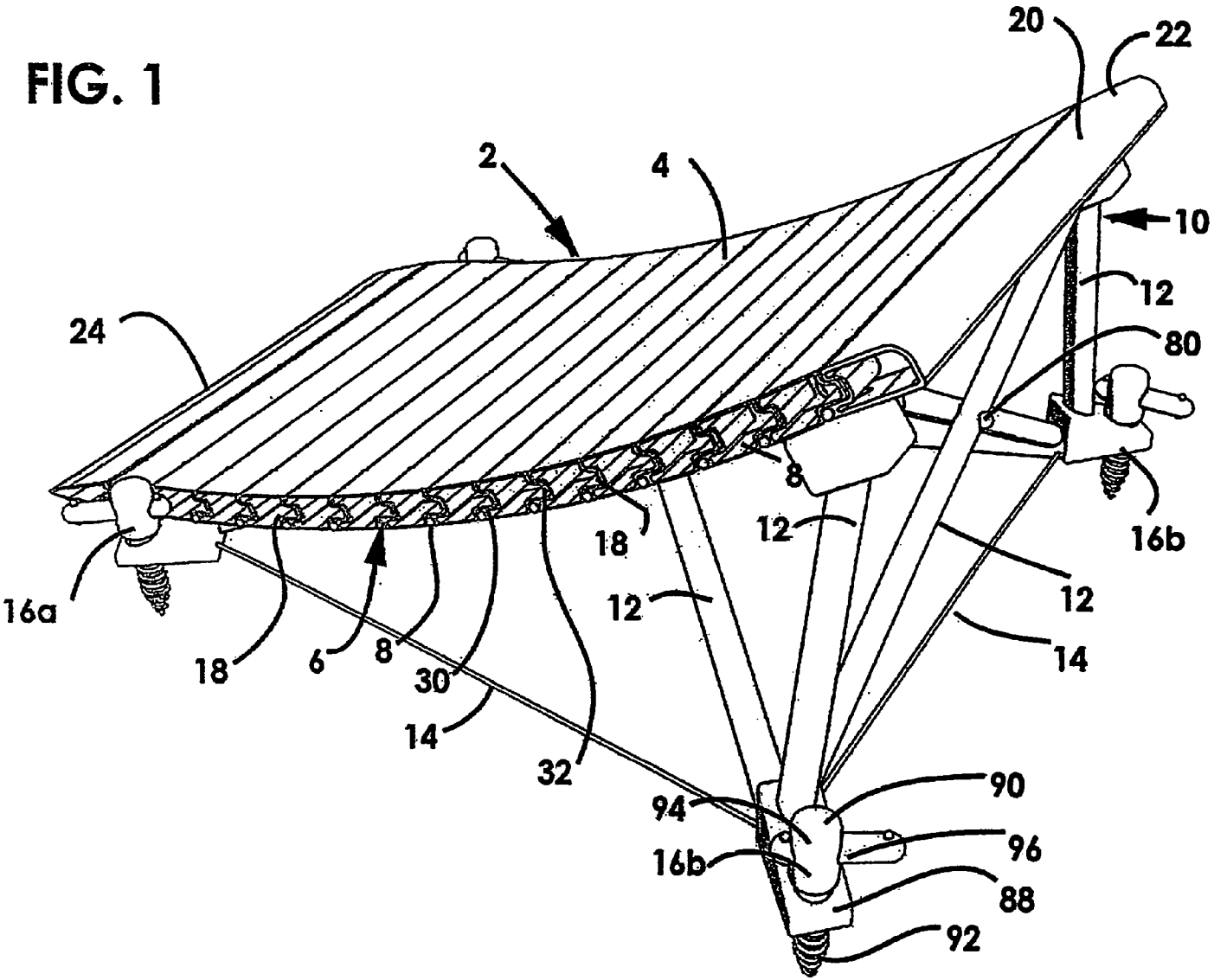
FIG. 1 shows a perspective view of a ramp according to a first embodiment of the invention.

A first embodiment of the ramp 2 is shown in FIG. 1 which includes deck 4 composed of a plurality of elongate members which will be referred to as slats 6 and which are hingeably interconnected by hinge pins 8. The ramp also includes a support structure 10 made up from a plurality of tubes 12 and tension wires 14. At the lower end of the support structure there are four feet 16*a*, 16*b*. The ramp is shown in its deployed configuration in FIG. 1 and in its non-deployed collapsed configuration in FIG. 2 ready for transportation.

In the embodiment shown in FIGS. 1 and 2 each slat 6 comprises a hollow prismatic section which may be an extruded metal section for example made of aluminium. The deck 4 comprises fourteen substantially identical centre section slats 18, an upper slat 20 with a curved upper distal edge 22 and a lower slat 24 with a tapered distal edge 26. The hinge pins 8 which pivotably interconnect adjacent slats at or adjacent to their lower surfaces 36 are of stainless steel and may extend the full width of the deck 4 or may be short pins which are positioned at either side of the deck and also possibly at one or more intermediate locations across the width of the deck. Each centre section slat 18 includes a tongue 30 extending along one side and a complementary groove 32 extending along its opposite side. The upper slat 20 has groove 34 similar to the grooves 32 of the centre section slats at its proximal edge. The lower slat 24 has a tongue (not shown) similar to the tongues 30 of the centre section slats at its proximal edge. When the deck 4 is in its deployed configuration each tongue is snugly accommodated within a groove of an adjacent slat. The tongues and grooves are configured to provide a form locking engagement between adjacent slats. For each hinged joint between adjacent slats, the tongue and groove are dimensioned and positioned relative to the associated hinge pin such that the tongue resiliently snaps into engagement with the groove when the deck is deployed and resiliently snaps out of it when the deck is rolled up. While tongues and grooves have been shown, other alternatives such as L-shaped engaging surfaces could be employed.

The lower surfaces 36 of the slats are provided with recesses (not shown in FIG. 1) for engagement of the deck 4 with the support structure 10. The general form of these recesses will be described below in the context of an alternative preferred deck construction shown in FIGS. 5 to 9 in which like parts having the same form and function as parts shown in FIG. 1 have been designated with the same reference numerals with a prime sign and will not be described in detail.

Figure 6:
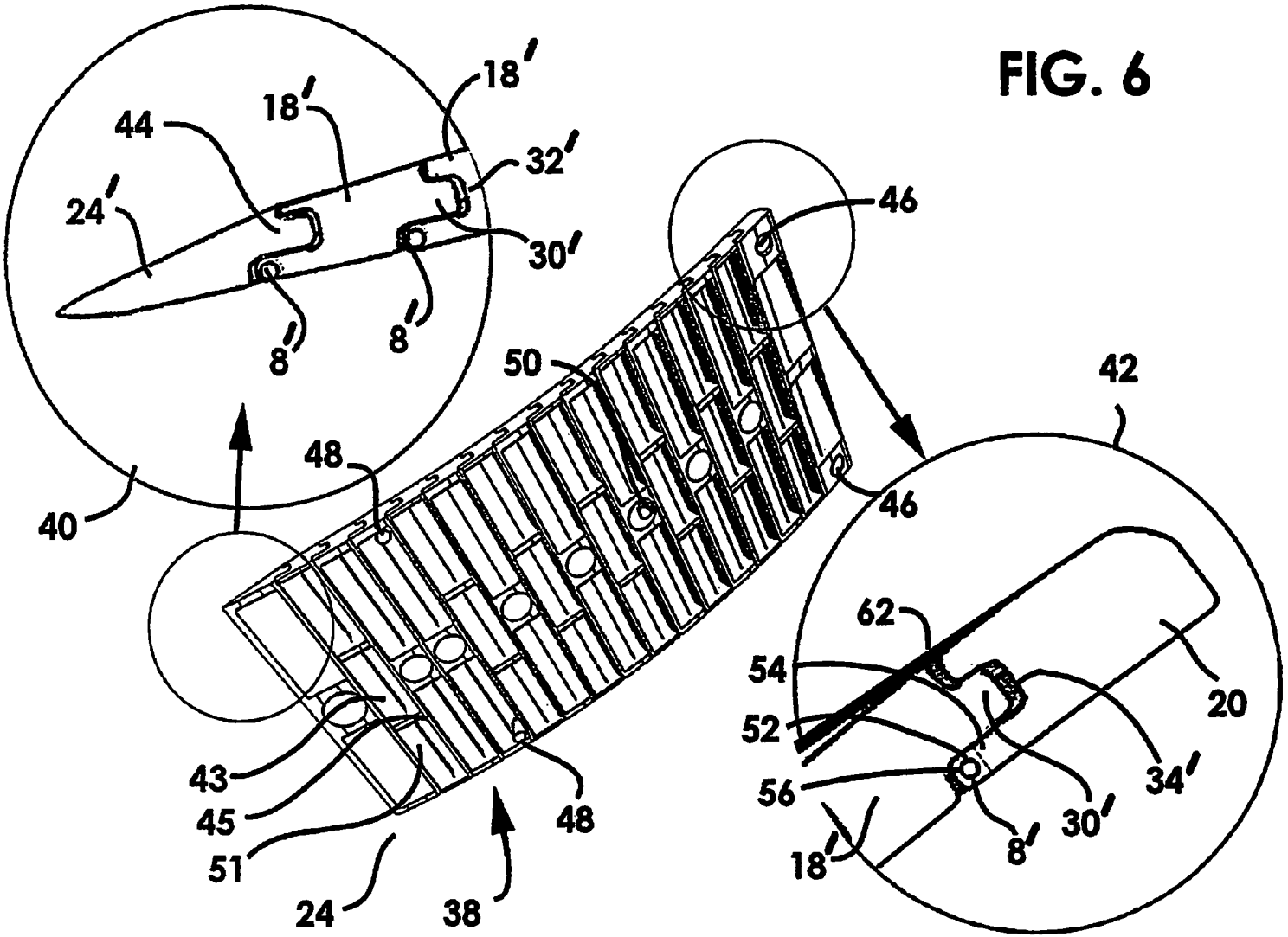
FIG. 6 shows an underside view of the deck shown in FIG. 5 and enlarged side elevations of end portions of the deck.

A perspective underside view of the alternative deck 38 is shown in FIG. 6 which includes an enlarged lower end view 40 and an enlarged upper end view 42 of the deck. The enlarged lower end view 40 shows the tongue 44 on the lower slat 24 not shown in FIG. 1.

The centre section slats 18' of the alternative deck 38 shown in FIG. 6 differ from the slats 18 shown in FIG. 1 in that they are not hollow tubular sections, they are instead moulded from plastics material such ABS plastic or some other suitable material. They have a generally tray like construction comprising a slightly curved central part 43 and a depending lip 45 extending around its perimeter. Reinforcing webs 51 extend across the slat a spaced locations along its length.

A cylindrical recess 46 is provided in the under side of the upper slat 20' adjacent each end thereof. A similar recess 48 is provided adjacent each end of one of the centre section slats 18' which is adjacent to the lower slat 24' (third slat in from the lower end) and another recess 50 is provided in the middle of a centre section slat around the middle of the deck 38. Similar recesses in equivalent positions will be provided in the underside of the deck 4 shown in FIG. 1 and are for engagement by parts of the support structure 10 as described below.

Each groove 32', 34' is bounded on its underside by an underside lip 52 which has gaps (not shown) which receive complementary underside shoulders 54 of an adjacent slat. The underside shoulders 54 project downwardly from the lower surface of each slat adjacent its tongue 30'. Aligned holes 56 in the lip 52 and shoulders 54 receive the hinge pin or pins 8.

Figure 9:
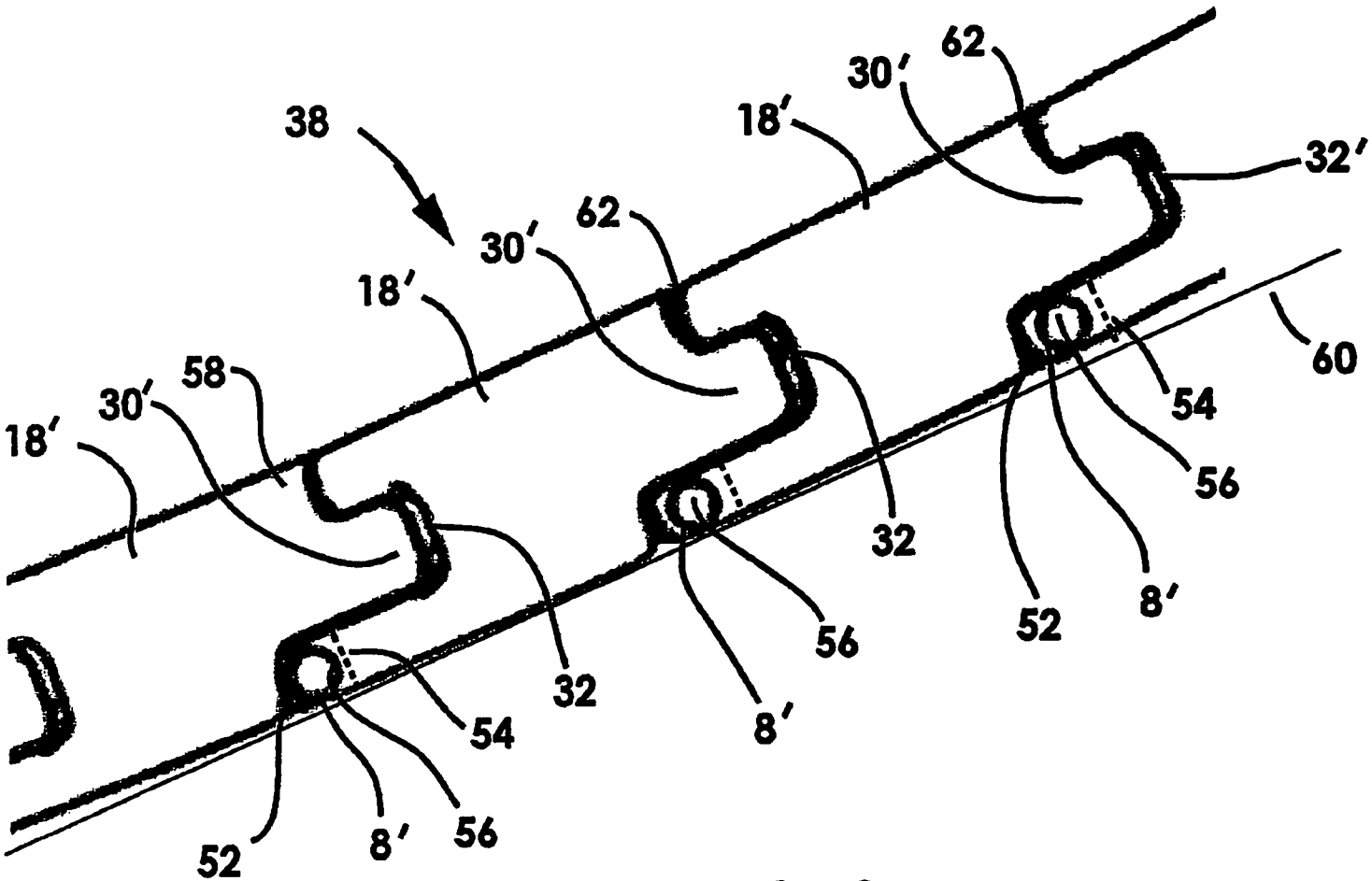
FIG. 9 shows an enlarged end view of part of the deck detailing interengagement of the elongate members from which it is constructed.

As shown in FIG. 9 the slats are configured such that when the deck is in the deployed configuration its upper surface is bowed slightly downwards and accordingly presents a slightly concave surface 58 which is substantially continuously curved. The amount of curvature is shown by comparison with the straight line 60 in FIG. 9. Furthermore the upper surface 62 of each slat is itself slightly curved and has a radius of curvature matching the overall curvature of the deck as determined by interengagement of the slats with each other. A tapered topside lip 62 extends along each slat in the region where its upper surface confronts an adjacent slat so as to minimise the jolt felt when a wheel passes from one slat to another.

Figure 5:
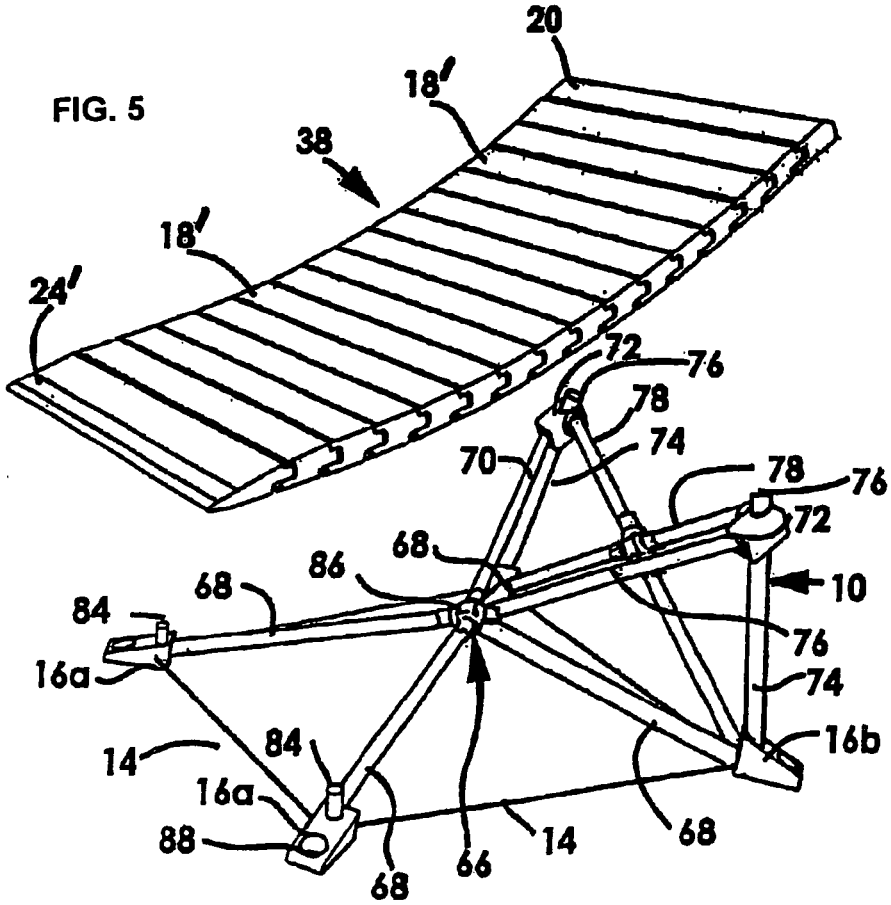
FIG. 5 shows the unrolled deck of a second embodiment of the invention ready to be installed on the fully deployed support frame.

With reference to FIG. 5 in particular the support structure 10 includes a central pivot joint 66 to which six tubes are pivotably connected. Four of these tubes are ground tubes 68 each of which extends downwardly and outwardly to one of the feet 16*a*, 16*b* and the other two of which are upper tubes 70 which extend upwardly and outwardly from the central pivot joint 66 to junctions, which in the example shown comprise junction blocks 72. A column tube 74 extends upwardly from each upper end foot 16*b* and has an upper end 76 which extends slightly through the associated junction block 72. Each upper end foot 16*b* is also connected to the junction block 72 on the other side of the ramp by a diagonally disposed bracing tube 78. Where the bracing tubes 78 cross they are connected to each other by a pivot pin as shown in FIG. 1 and may be covered by a flexible sleeve 82 as shown in FIG. 5.

Each lower end foot 16*a* has a protrusion 84 extending upwardly therefrom which in the present embodiment is a short cylindrical protrusion. A similar protrusion 86 extends upwardly from the central pivot joint 66. Each foot 16*a*, 16*b* also includes a substantially vertically disposed through aperture 88 for accommodating a securing device 90 having a lower end 92 which is threaded and an upper end 94 which has a torque bar extending therethrough for winding the threaded lower end 92 into ground on which the support structure is positioned. The threaded lower ends 92 will be suitable for engagement with soil, snow and any other similar surface. Undersides of the feet are provided with friction enhancing pads 98 (shown in FIG. 8) which may be in the form of rubber pads for restraining the ramp against lateral displacement when it is positioned on ground into which it is not possible or desirable to screw the securing devices 90. In such a situation the securing devices 90 would not be inserted into the through apertures 88.

One of the tension wires 14 extends from each foot to an adjacent foot thereby connecting the four feet to form a quadrilateral. The tension wires are of such a length that they prevent the feet from spreading beyond the deployed configuration shown in FIG. 5.

Figure 7:
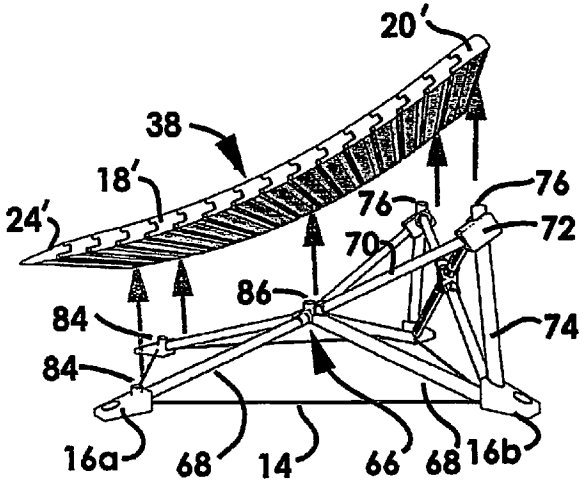
FIGS. 7 & 8 show further views of the deck ready for connection to the support structure.

With the deck 38 unrolled and the support structure 10 erected as shown in FIG. 5 the deck 38 is lowered onto the support structure 10 as shown in FIG. 7. The protrusions 84 on the lower end feet 16*a* engage the recesses 48 (see FIG. 6) in the lower surface of one of the central section slats close to the lower slat 24', the protrusion 86 on the central pivot joint engages the recess 50 in the lower surface of one of the centrally positioned slats and the upper ends 76 of the column tubes 74 engage the recesses 46 in the lower surface of the upper slat 20'. Locking devices may be provided for securing the deck slats to the support structure 10 to prevent the deck from jumping off the support structure.

Figure 4:
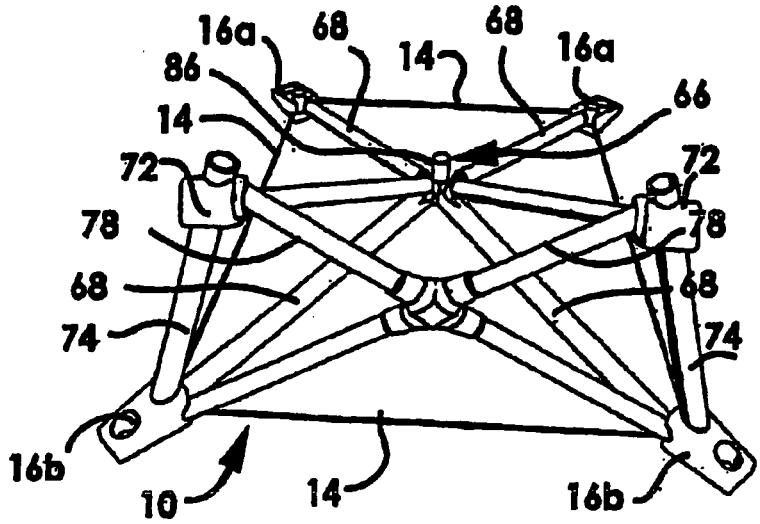
FIG. 4 shows the support frame in a fully deployed state.
Figure 8:
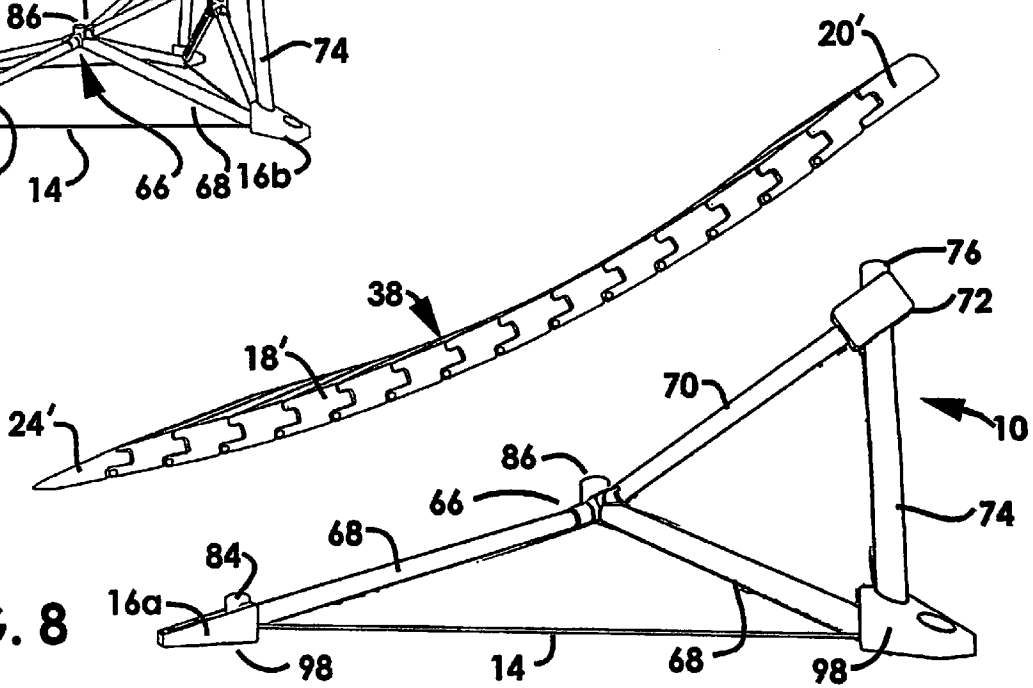

For transportation purposes the ramp 2 will be in the state shown in FIG. 2 with the deck 4 rolled compactly, the support structure 10 collapsed with its tubes disposed generally parallel and close to each other, the securing devices 90 removed from the feet 16*a*, 16*b* and the tension wires 14 separated from other parts of the support structure 10. The tension wires 14 may alternatively be left connected to the support structure. When the ramp is to be deployed the feet 16*a*, 16*b* are first pulled away from each other as shown in FIG. 3. As this occurs the central pivot joint 66 moves downwardly and the angle between the bracing tubes 78 increases as they pivot relative to each other about the pivot pin 80. One of the tension wires 14 will then be connected between each pair of adjacent feet and the feet then separated further until the tension wires 14 come under tension. The upper tubes 76 and bracing tubes 78 will then be engaged with the junction blocks 72 possibly by being forced into cylindrical recesses therein. The support structure will then be in the configuration shown in FIG. 4 and ready for the deck to be attached thereto as shown in FIGS. 5, 7 and 8 and as described above. The securing devices can also be used to secure the feet if appropriate. The ramp is then ready for use by skate boarders and the like.

A further embodiment of the invention will now be described with reference to FIGS. 10 to 19.

The ramp 100 includes a deck 102 and a support structure 104.

The deck 102 is made up from five panels including a lower panel 106 (at an entry end 109 of the ramp) with a tapered distal edge 108, three intermediate panels 110, 112 and 114 and an upper panel 116 (at an exit end 117 of the ramp) with a curved upper distal edge 118. A different number of intermediate panels may be employed. The interface between each pair of adjacent panels is defined by a tongue 120 running along an edge of one of the panels which engages a complementary groove 122 running along a confronting edge of the other panel. A pair of spaced filaments 123, which may comprise cord or wire, extend between each pair of adjacent panels as shown in FIG. 15. These filaments are of such a length that the panels can be separated sufficiently to permit the deck to be folded so that the panels are superimposed on top of each other, preferably in a zig-zag manner. The deck 102, in a partly folded state, is shown in FIG. 16. In its fully folded state, the panels will lie against each other. Near each side of the deck, filament 123 may extend from one end of the deployed deck to the other and interconnect all of the panels together or alternatively two separate filament sections may interconnect each pair of adjacent panels.

The panels are moulded from ABS plastic or any other suitable material and may have a similar form to those described above and include a central panel part having a peripheral lip and one or more reinforcing webs extending downwardly from the central panel part. The undersides of the panels are provided with downwardly projecting protrusions 124.

The support structure 104 includes three longitudinal deck supporting members 126 each comprising a lower section 128 and an upper section 130 which are interconnected by a hinge 132 adjacent upper surfaces 134 of the upper and lower sections. Towards lower surfaces 136 of the upper and lower sections a spring biased catch 138 is provided on each lateral side of the lower section 128 (see FIG. 19). Each catch is biased into engagement with a complementary pin 140 on the corresponding upper section 130 and acts to hold the lower and upper sections 128 and 130 in the opened or deployed configuration shown in FIGS. 11 and 12.

Each adjacent pair of longitudinal members 126 are transversely connected by three collapsible brace means 140 each comprising a pair of brace arms 142 hinged to each other by an elbow joint 144 and having distal ends pivotably connected to respective longitudinal members 126. While three bracing means 140 are shown between each pair of longitudinal members 126, more or less could be employed. The upper surfaces 134 of the lower and upper sections 128 and 130 are provided with recesses 146 which complement the protrusions 124 on the deck panels by way of shape and distribution. The protrusions 124 and recesses 146 are shown as being cylindrical but some other shape could be employed.

A relatively longer leg 148 and a relatively shorter leg 150 are connected to each upper section 130 by means of a hinge plate 162 situated on each side of an upper end of the leg which permit the leg to move between a deployed position projecting substantially perpendicularly from the associated upper section 130 (see FIG. 12) and a stowed position in which the leg lies substantially parallel and closely adjacent to the upper section 130 (see FIG. 18). Each hinge plate 152 is connected so as to rotate with the associated leg by rotating around a pivot pin 154 projecting from a side of the associated upper section 130. An outwardly biased detent 158, projecting from a side of the upper section 130 is positioned to snap-engage in a complementary hold 156 in the hinge plate 152 as the leg reaches its fully deployed position thereby holding it in that position.

Figure 14:
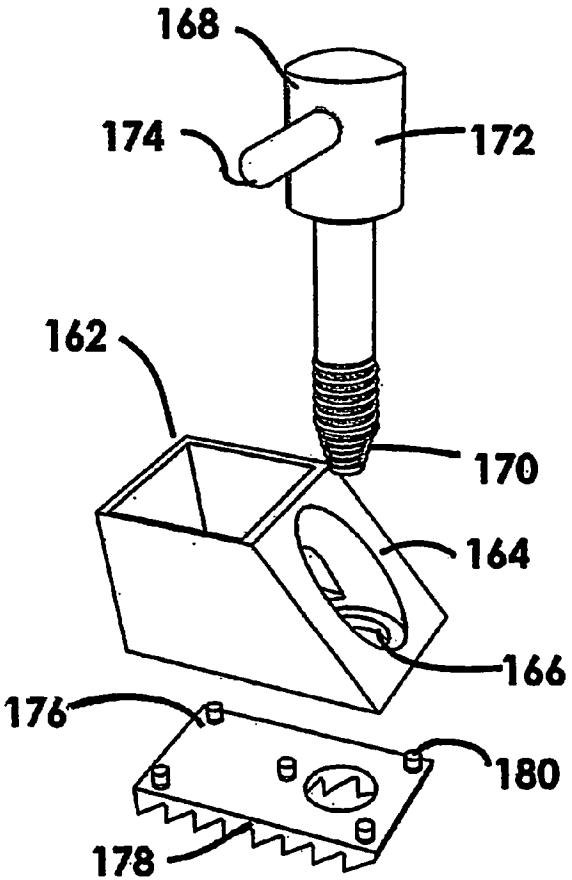
FIG. 14 shows a perspective view of a further foot of the ramp shown in FIG. 10.

A foot 160, shown in detail in FIG. 14, is provided at the distal end of each leg 148 and 150 which has a leg hole 162 for receiving a respective leg. A projecting portion 164 of each foot 160 has a through hole 166 for receipt of a securing device 168 having a threaded lower end 170 and an upper end 172 with a torque bar 174 for assisting with winding the threaded lower end 170 into the ground. An underside of each foot 160 is provided with a gripping pad 176 having a ribbed gripping surface 178 on its lower surface and pegs 180 which engage complementary holes (not shown) in the underside of each foot 160.

Figure 13:
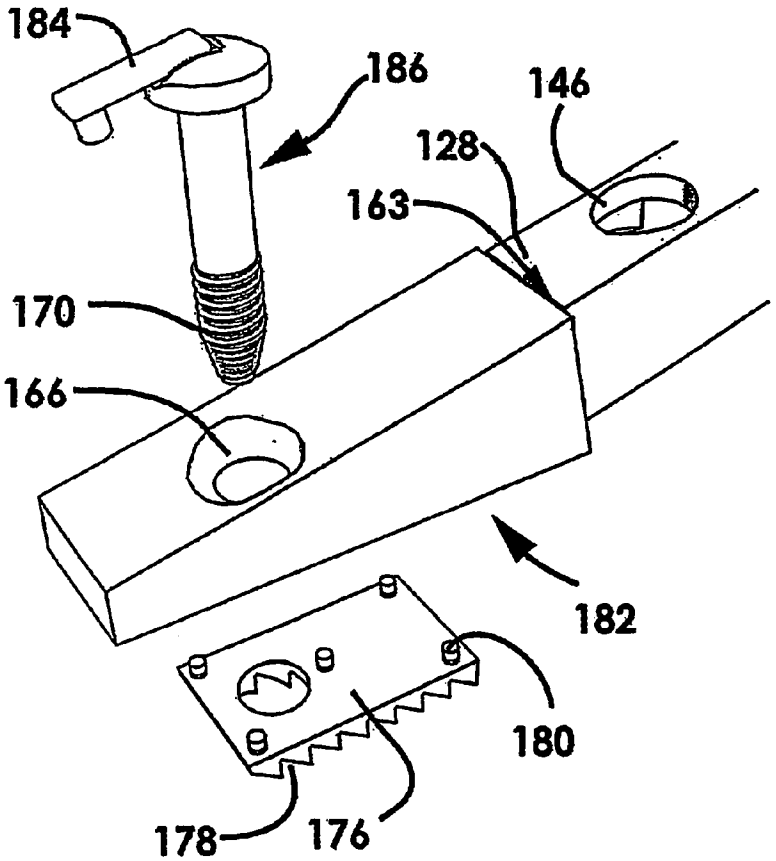
FIG. 13 shows a perspective view of one type of foot of the ramp shown in FIG. 10.
Figure 19:
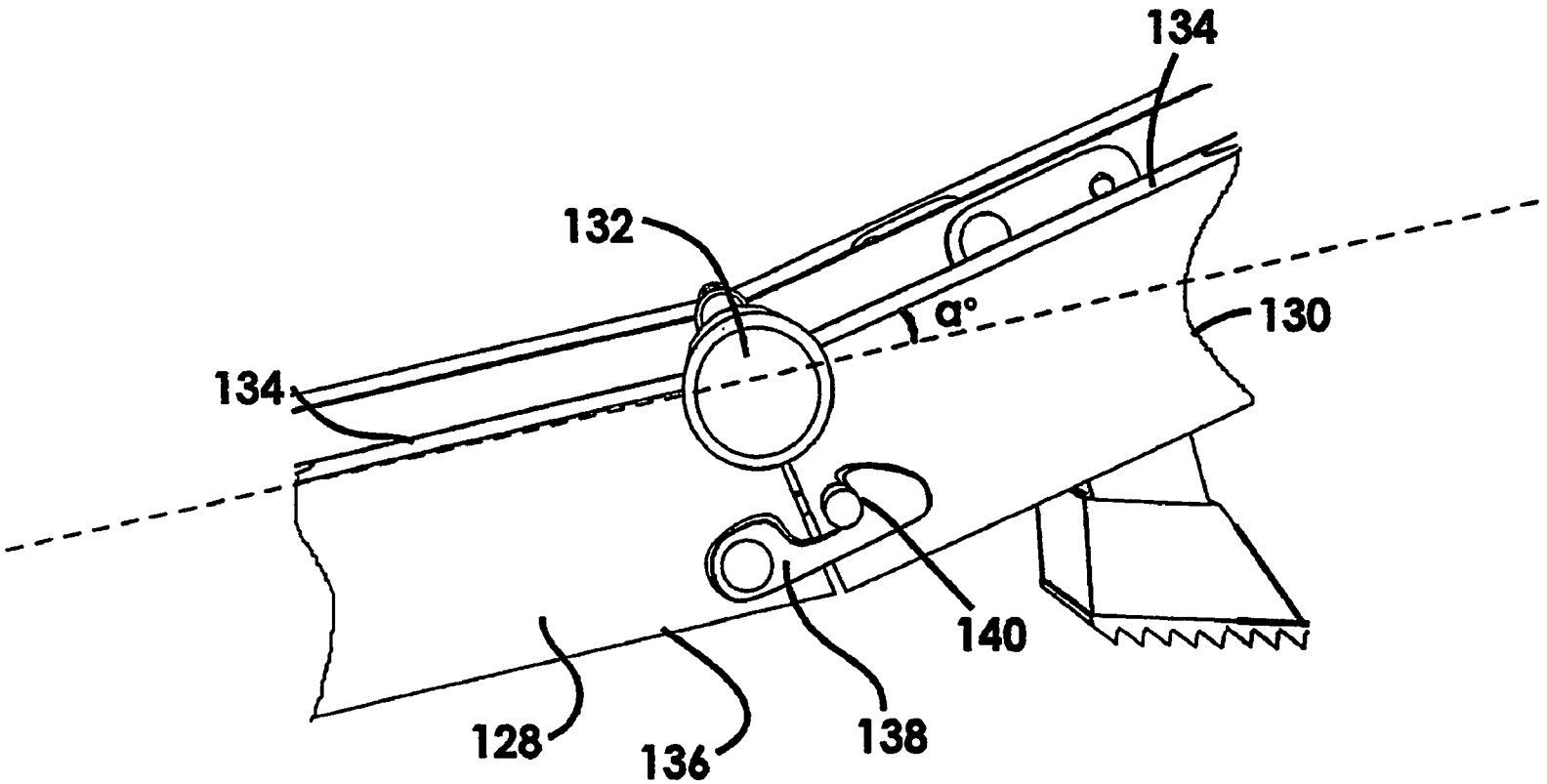
FIG. 19 shows a side view of a hinge portion of the support structure of the ramp shown in FIG. 10.

An alternative entry end foot 182, shown in detail in FIG. 13, is provided at the distal end of each lower section 128 and differs from the leg end foot 160 in that it includes a hole 163 for receiving a roughly horizontally extending distal end of a lower end section 128 rather than a distal end of a leg. A displaceable handle 184 is provided at the upper end of the alternative securing device 186 which can be flipped over when not in use to avoid it fouling with the lower panel 106.

Figure 10:
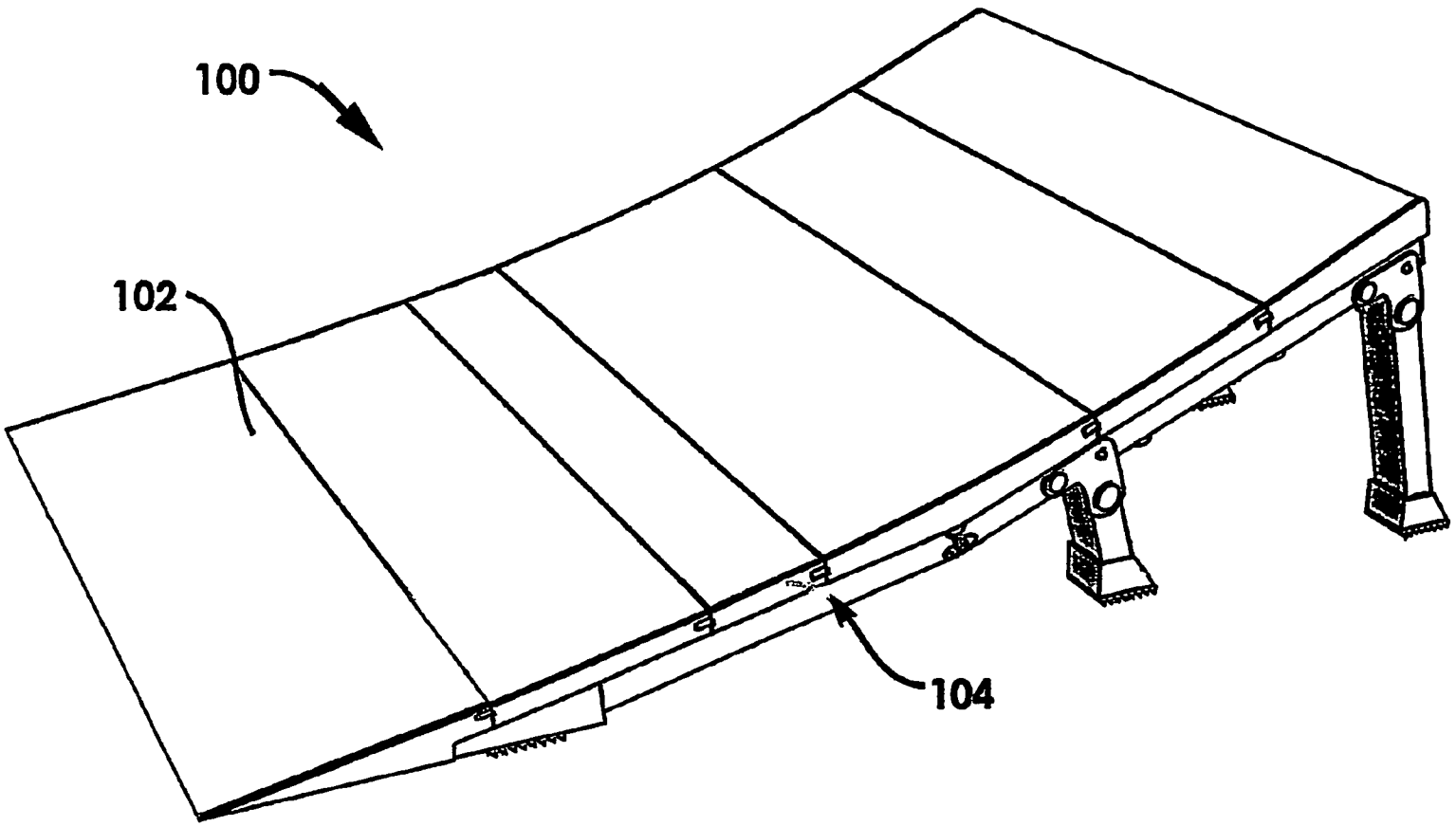
FIG. 10 shows a perspective view from above of a ramp according to a third embodiment of the invention.
Figure 11:
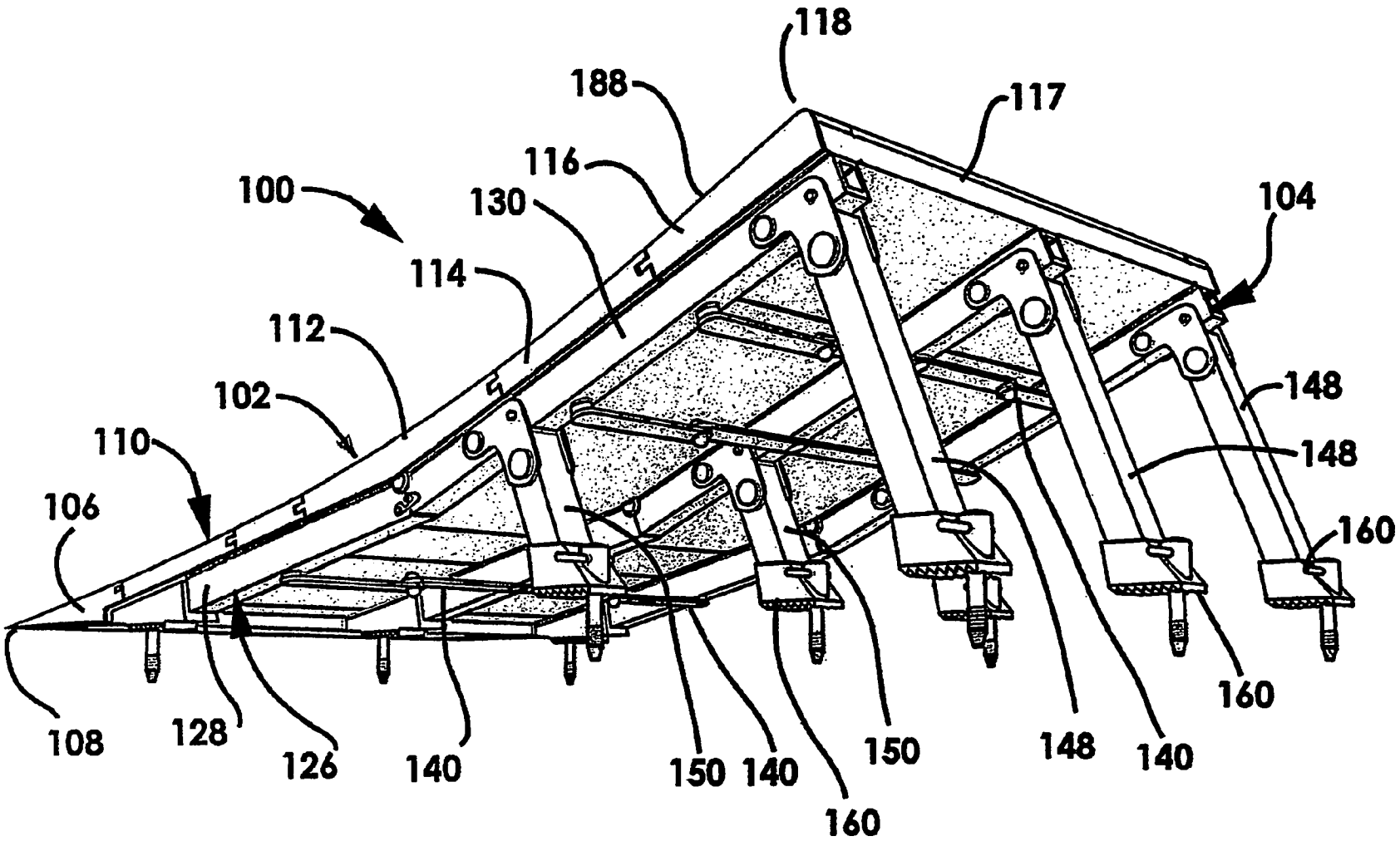
FIG. 11 shows a perspective view from below of the ramp shown in FIG. 10.
Figure 12:
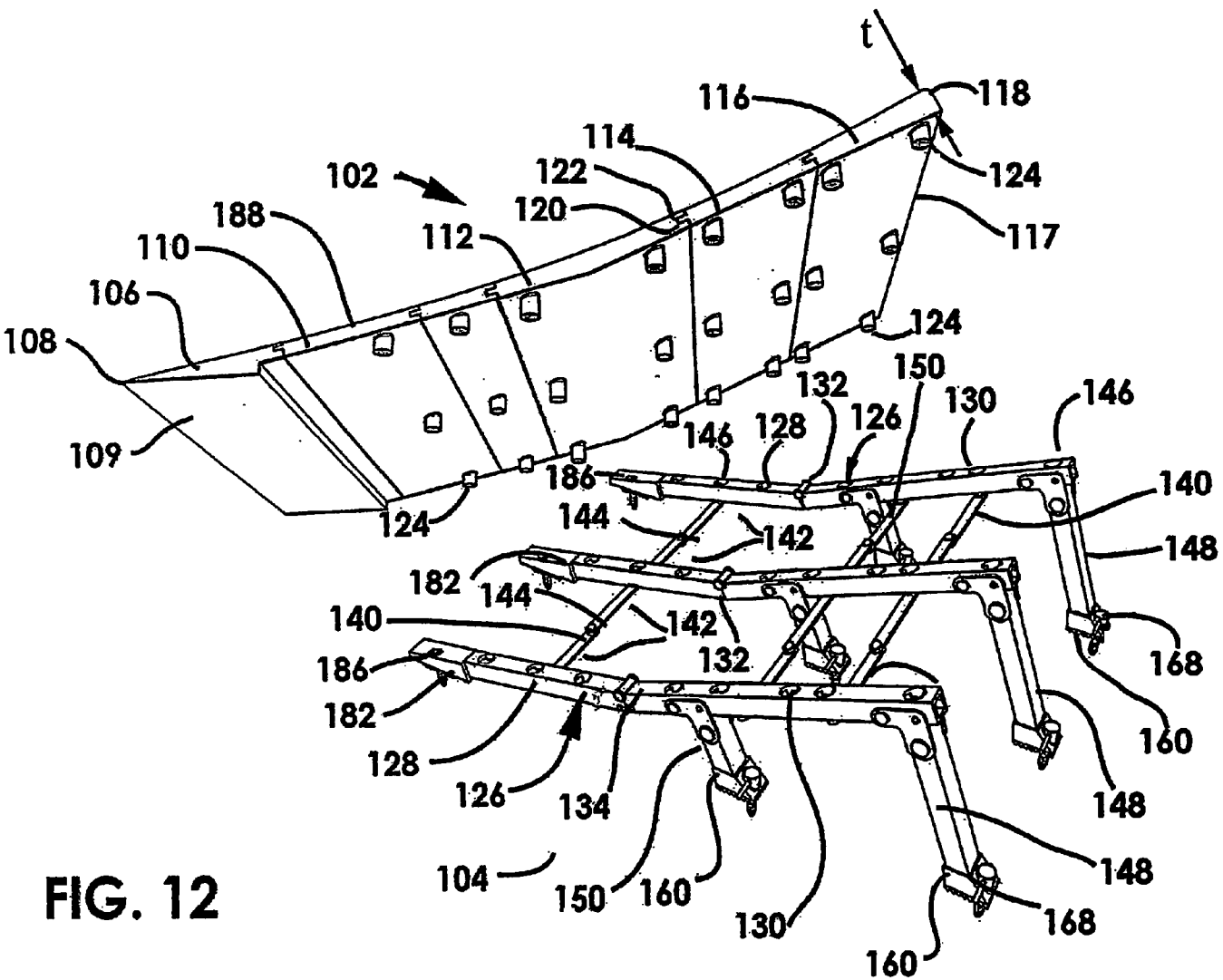
FIG. 12 shows a perspective view of the ramp shown in FIG. 10 with the deck separated from the support structure.

When the ramp 100 is deployed as shown in FIG. 10, each protrusion 124 is accommodated snugly in a complementary recess 146, each detent 158 projects through its complementary hole 156 and each catch 138 engages its complementary pin 140. The upper surfaces 134 of the lower and upper sections 128 and 130 define two planes disposed at an angle a° to each other which is preferably in the order of 7° to 17°. The cross-sectional profiles or thicknesses t of the panels are such that their upper surfaces 188 together define a substantially continuous curve which is preferably also substantially a transition curve ( i.e. one in which the radius of curvature varies in a continuous and no-abrupt manner) starting from a large or substantially infinite radius of curvature adjacent the entry end 108 and decreasing steadily towards the exit end 117. With such a configuration, a skateboarder rolling onto the ramp will be accelerated upwardly in a smooth continuous manner before being launched off the exit end 117 of the upper panel 116. To provide the required curvature the panels are not of uniform thickness or depth. For example the upper panel 116 is thicker than the intermediate panel 114 and has a distal edge which is thicker than its proximal edge (see FIG. 12).

The transverse width of the panels is such that they hold each pair of brace arms 142 substantially aligned with each other and prevent movement of the longitudinal members 126 towards each other.

When the ramp 100 is to be collapsed, the deck 102 is lifted off the support structure 104 and the panels 106, 110, 112, 114 and 116 are separated from each other slightly as shown in FIG. 15. At this point, the filaments 124 prevent the panels from becoming detached from each other and permit the panels of the deck 102 to be folded up in a zig-zag manner as shown in FIG. 16.

If the securing devices 168 and 186 have been used to secure the feet 160 and 182 to a supporting surface, these will be unscrewed therefrom and removed from the feet.

Each detent 158 is then pushed inwardly, out of engagement with its complimentary hole 156 in one of the hinge plates 152, and the legs 148 and 150 are folded so as to lie along the lower surface 136 of the associated upper section 130 as shown in FIG. 17.

Each catch 138 is pivoted downwardly out of engagement with its associated pin 140 and each lower section 128 is pivoted upwardly about its hinge 132 so as to be folded onto the upper surface 134 of the associated upper section 130 moving through the positions shown in FIG. 17.

All elbow joints 114 are moved in the direction of arrow A in FIG. 17 and the folded longitudinal members 126 are simultaneously moved towards each other in the direction of arrow B in FIG. 17.

The final completely folded state of the support structure 104, with the longitudinal members 126 completely folded and moved substantially together, is shown in FIG. 18. The folded deck and support structure can then be easily transported by a single person.

The ramp described above can easily be designed so as to be portable by a single person and provides an excellent means for launching skateboarders and the like for the purpose of executing airborne manoeuvres.

While particular embodiments have been described, it will be understood that variations may be made which do not depart from the scope of the invention.

The invention claimed is:

1. Collapsible ramp comprising a collapsible deck including a plurality of elongate members and a collapsible support structure, the elongate members and support structure being configured such that when the deck is deployed on the support structure the deck has a generally concave upper surface and the ramp can be collapsed when not deployed, wherein the support structure includes longitudinal members laterally interconnected by collapsible bracing means, which bracing means are collapsible to permit adjacent longitudinal members to move towards each other.

2. The ramp of claim 1 wherein, the upper surface of the deployed deck substantially defines a transition curve.

3. The ramp of claim 1 wherein the upper surface of the deployed deck is substantially continuously curved.

4. The ramp of claim 1 wherein the elongate members engage each other in a form locking manner when the deck is deployed.

5. The ramp of claim 1 wherein the elongate members are interconnected whereby when the deck is separated from the support structure and in its collapsed state, the elongate members remain connected to each other.

6. The ramp of claim 5 wherein the elongate members are interconnected by at least one filament.

7. The ramp of claim 5 wherein the elongate members are interconnected by hinges with axes disposed parallel to longitudinal axes of the elongate members and are configured to allow the deck to be rolled up when collapsed.

8. The ramp of claim 1 wherein an entry end of the deck is tapered so as to provide a smooth transition onto the ramp.

9. The ramp of claim 1 wherein an exit end of the deck has a rounded upper distal edge.

10. The ramp (100) of claim 1 wherein the elongate members are moulded plastics members.

11. The ramp of claim 1 wherein the support structure includes deck support members and legs which are hingeably connected to the deck support members.

12. The ramp of claim 1 wherein first engagement means on an underside of the deck is adapted to selectively engage complementary second engagement means on the support structure.

13. The ramp according to claim 1 wherein the support structure includes feet with through apertures and fastening means adapted to pass through the apertures for engagement with a ramp support surface.

14. Collapsible ramp comprising a collapsible deck including a plurality of elongate members and a collapsible support structure, the elongate members and support structure being configured such that when the deck is deployed on the support structure the deck has a generally concave upper surface and the ramp can be collapsed when not deployed, wherein the support structure comprises longitudinal members which are hingebly interconnected in such a manner that they remain interconnected when the support structure is in a collapsed state, and each longitudinal member is foldable so as to reduce its length.

15. The ramp of claim 14 wherein the upper surface of the deployed deck substantially defines a transition curve.

16. The ramp of claim 14 wherein the elongate members engage each other in a form locking manner when the deck is deployed.

17. The ramp of claim 14 wherein the elongate members are interconnected whereby when the deck is separated from the support structure and in its collapsed state, the elongate members remain connected to each other.

18. The ramp of claim 17 wherein the elongate members are interconnected by at least one filament.

19. The ramp of claim 14 wherein the support structure includes deck support members and legs which are hingeably connected to the deck support members.

20. The ramp of claim 14 wherein first engagement means on an underside of the deck is adapted to selectively engage complementary second engagement means on the support structure.

* * * * *